US007972575B2

(12) United States Patent
Lind

(10) Patent No.: US 7,972,575 B2
(45) Date of Patent: Jul. 5, 2011

(54) TWO-PHASE PIPETTE

(75) Inventor: Mikael Lind, Helsinki (FI)

(73) Assignee: Thermo Electron Oy, Vantaa (FI)

( * ) Notice: Subject to any disclaimer, the term of this patent is extended or adjusted under 35 U.S.C. 154(b) by 427 days.

(21) Appl. No.: 11/919,879

(22) PCT Filed: May 5, 2006

(86) PCT No.: PCT/FI2006/000146

§ 371 (c)(1),
(2), (4) Date: Dec. 16, 2008

(87) PCT Pub. No.: WO2006/120284

PCT Pub. Date: Nov. 16, 2006

(65) Prior Publication Data

US 2009/0117008 A1 May 7, 2009

(30) Foreign Application Priority Data

May 6, 2005 (FI) ..... 20050483

(51) Int. Cl.
*B01L 3/00* (2006.01)
*B01L 3/02* (2006.01)

(52) U.S. Cl. ..... 422/501; 73/864.13

(58) Field of Classification Search ..... 422/501; 73/864.13

See application file for complete search history.

(56) References Cited

U.S. PATENT DOCUMENTS

| | | | | |
|---|---|---|---|---|
| 3,343,539 | A | 9/1967 | Moorhouse | |
| 3,665,980 | A * | 5/1972 | Croslin et al. | 141/183 |
| 4,158,035 | A * | 6/1979 | Haase et al. | 73/863.32 |
| 4,369,665 | A * | 1/1983 | Citrin | 73/864.18 |
| 4,442,722 | A | 4/1984 | Meyer et al. | |
| 4,821,586 | A * | 4/1989 | Scordato et al. | 73/864.18 |
| 6,923,938 | B2 * | 8/2005 | Cote et al. | 422/525 |
| 7,574,929 | B2 * | 8/2009 | Telimaa et al. | 73/864.16 |
| 2002/0005075 | A1 * | 1/2002 | Kriz et al. | 73/864.18 |
| 2002/0020233 | A1 | 2/2002 | Baba et al. | |
| 2007/0283743 | A1 * | 12/2007 | Telimaa et al. | 73/1.74 |

FOREIGN PATENT DOCUMENTS

FI 44 070 4/1971

* cited by examiner

*Primary Examiner* — Lore Jarrett
(74) *Attorney, Agent, or Firm* — Nixon & Vanderhye P.C.

(57) ABSTRACT

The invention relates to a two-phase electronic pipette, in which the piston can be moved from the basic position to the lower position and in which the distance between basic position and lower position can be changed.

3 Claims, 4 Drawing Sheets

TWO-PHASE PIPETTE

Figure 1:
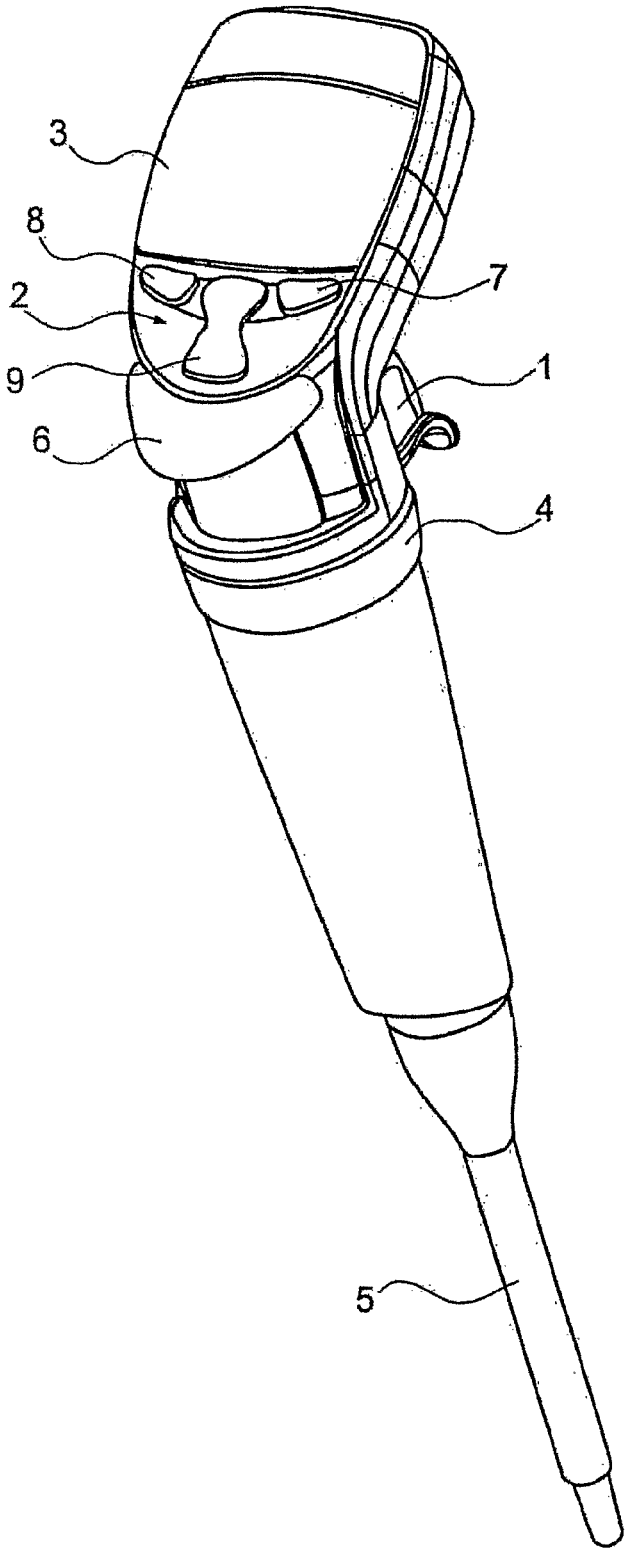

This application is the U.S. national phase of International Application No. PCT/FI2006/000146 filed 5 May 2006 which designated the U.S. and claims priority to Finland Application No. 20050483 filed 6 May 2005, the entire contents of each of which are hereby incorporated by reference.

FIELD OF TECHNOLOGY

The invention relates to a pipette for use for liquid dosage comprising a motor-operated piston. The invention relates specifically to the operation of the movement of the piston.

TECHNICAL BACKGROUND

Pipettes are used for liquid dosage in laboratories, the pipettes comprising a piston movable in a cylinder by means of an electric motor, by which piston liquid is aspirated in accordance with selected pipette function into and out of a tip connected to the cylinder. The liquid volume is usually adjustable. Pipettes comprise a control system and its user interface for i.a. setting of the volume and other necessary adjustments and for giving commands for performing operations. The user interface has the necessary push buttons for this purpose. The user interface also has a display by means of which i.a. the volume and other necessary data can be displayed. The display can also show menus by means of which the functions can be selected and settings fed using the push buttons.

The pipetting functions to be used are e.g. direct, reverse and step pipetting. Direct pipetting involves aspiration of a desired volume into the pipette and discharge of the volume. Reverse pipetting function involves aspiration of a volume greater than the one desired into the pipette, with the desired volume being subsequently discharged. Step pipetting involves aspiration of a volume into the pipette, the volume being subsequently discharged in a plurality of minor portions.

The piston has a basic position from which it can be moved upwards to an upper position. The distance between these positions defines the dosable volume. In addition, the piston has a lower position to which the piston can be moved downwards from the basic position by the length a so-called secondary movement. In direct pipetting the piston is moved from the basic position to the upper position when aspirating liquid and from the upper position to the lower position when discharging liquid. The secondary movement thus ensures that the liquid is discharged as completely as possible. In reverse pipetting the piston is moved from the lower position to the upper position when aspiring the liquid and from the upper position to the basic position when discharging the liquid. In step pipetting the piston is moved from the lower position to the upper position when aspirating the liquid and from the upper position step to the basic position when discharging the liquid. In step pipetting the excess volume aspirated by the secondary movement specifically ensures that also the last dosage to be discharged is full. In reverse pipetting and step pipetting the volume corresponding to the secondary movement is usually thrown away after pipetting. In known electronic pipettes the length of the secondary movement is constant.

Publication U.S. Pat. No. 3,343,539 discloses a dispensing device corresponding to a manually operated pipette in which also the length of the secondary movement is adjustable. Publication FI 44 070 discloses a manually operated pipette in which also the length of the secondary movement is adjustable, specifically the same distance as the primary movement and together and simultaneously with the primary movement.

SUMMARY OF THE INVENTION

An electronic pipette according to claim 1 has now been invented.

In accordance with the invention the length of the secondary movement is adjustable. The user can thus change it to as optimal as possible for each pipetting function.

DRAWINGS

Figure 2:
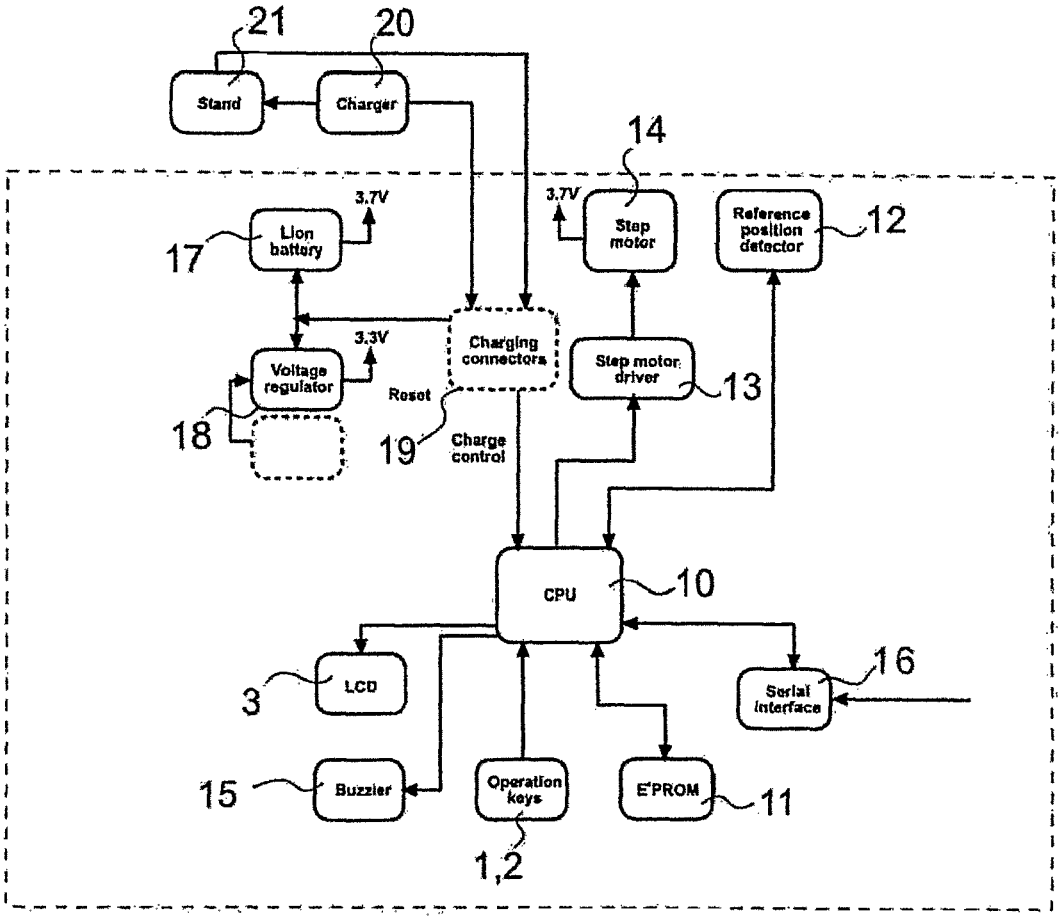
Figure 3:
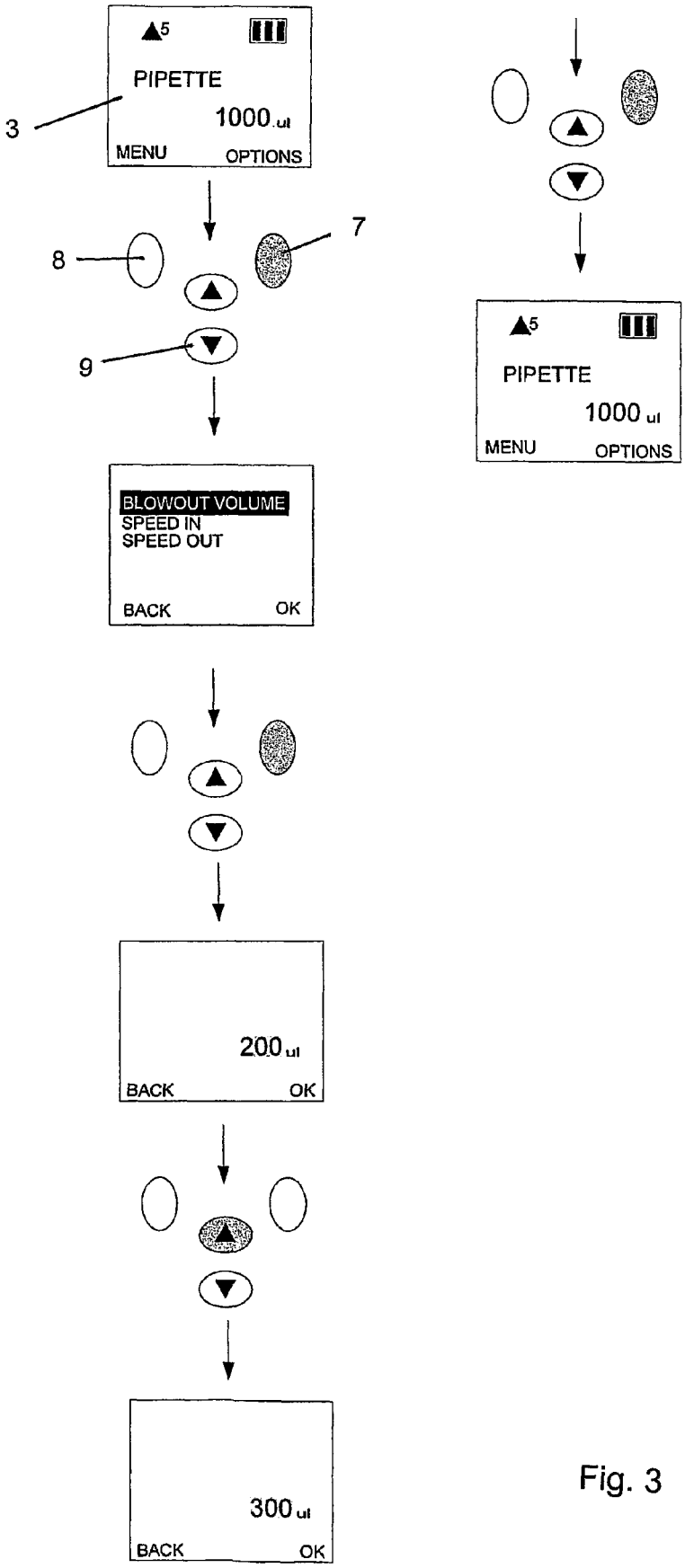

The accompanying drawings pertain to the written description of the invention and relate to the following detailed disclosure of the invention. In the drawings FIG. 1 illustrates a pipette according the invention FIG. 2 illustrates a function of the pipette as a chart FIG. 3 illustrates how the discharge volume corresponding to the secondary movement of direct pipetting can be changed.

Figure 4:
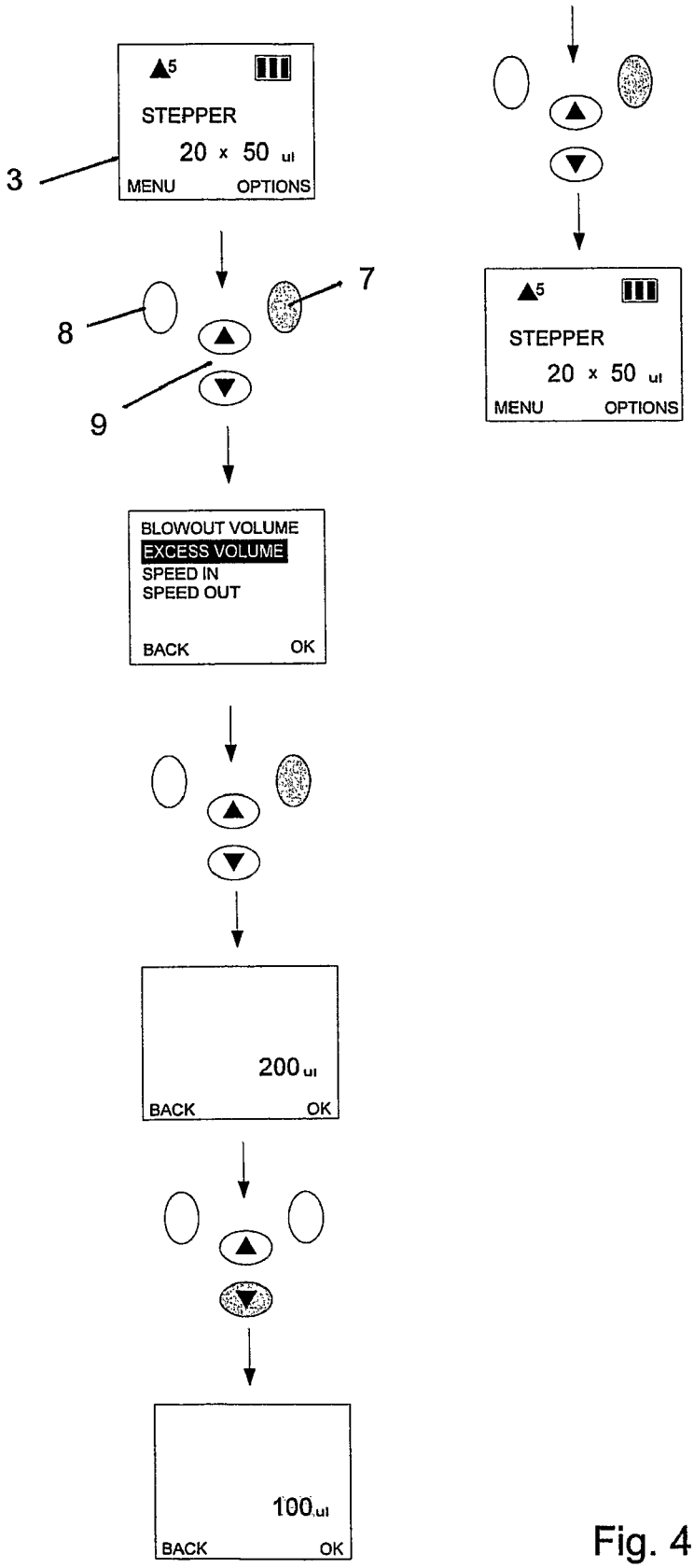

FIG. 4 illustrates how the excess volume of the step function can be changed.

DETAILED DISCLOSURE OF THE INVENTION

In a pipette according to the invention the piston is moved by means of a motor. The piston has a basic position from which it can be moved upwards to an upper position. The distance between these positions defines the dosable volume. In addition, the piston has a lower position to which the piston can be moved downwards from the basic position by the length of a so-called secondary movement. The length of this secondary movement is adjustable. The user can thus change it as optimal as possible for each pipetting function.

In direct pipetting a discharge as complete as possible is ensured by the secondary movement. According to the invention the length of the secondary movement can be set suitable depending on the pipetting function in question. This is a benefit for example when dosing into a liquid and when it is desirable that no air gets into the liquid when doing this. The discharge can thus be optimized by adjustment so that the tip is just barely emptied and no air gets into the liquid from the tip.

In reverse and step pipetting the excess dosage is aspirated by the secondary movement. In this case adjustability of the secondary movement is especially beneficial because the excess liquid aspirated into the pipette by the secondary movement must usually be thrown away after pipetting. When this excess volume can be set as small as possible so that the accuracy requirement for each pipetting function, however, is fulfilled, reagent is saved and waste is reduced.

The extra discharge movement can also be used in reverse and step function, whereby the piston is driven lower than when aspirating liquid. In this way a discharge of the tip as complete as possible is confirmed. It is then actually a three-phase pipette, in which the piston has two lower positions: a lower position for aspiration and below it a lower position for discharge. Also the discharge movement can be made adjustable. According to the invention it is also possible to make a special arrangement in which the lower position for aspiration is constant and the lower position for discharge is adjustable.

There is a user interface associated with the control system of the pipette, which interface comprises setting keys, an operation switch and a display.

The display shows e.g. the volume and possibly other necessary data. The display also shows menus allowing data input in the control system by means of the setting keys, the data comprising e.g. selecting the desired pipetting function and the settings used for this.

In other respects, the pipette mechanism and the control system may operate on the same principle as e.g. those in Finnpipette® Novus pipette which came into the market in 2004 (manufacturer: Thermo Electron Oy, Finland) or as disclosed in FI 96007 (corresponding to EP 576967).

Some embodiments of the invention are exemplified below.

FIG. 1 illustrates a pipette operated with an electric motor. The user interface of the control system comprises an operating switch 1, setting keyboard 2 and a display 3.

The operating switch 1 has been disposed in a wheel 4 rotatable relative to the body. This allows the user to adjust the position of the operating switch. A push-button 6 of the tip removal sleeve 5 is provided in the pipette body on the opposite side of the switch. The tip is discharged by manual force. It has preferably been relieved by a lever mechanism, especially by such in which the tip remover is urged to move by means of a wheel relative to the pipette body, as described in FI 92374 (corresponding e.g. to EP 566939).

The display 3 is disposed at the top of the pipette, in a position upwardly oblique away from the push-button 6 of the tip removal sleeve on the upper surface of a projection. A power source is provided within the projection. The setting keyboard 2 is disposed on the upper surface of the projection, at its end on the side of the body. The display shows necessary information about the settings used each time, such as e.g. the pipette volume and function in use and the current function step. The display also shows different menus in each situation, allowing the settings to be changed.

The pipette settings can be changed by means of the setting keyboard 2. The setting keys are: a right-hand selection key 7, a left-hand selection key 8 and a bifunctional scanning key (arrow keys) 9. The current is switched on by depression of any key. Depending on the setting step, the selection keys allow the user to move forwards or backwards in a menu hierarchy or to start using a selected function. Depending on the setting step, the scanning key allows the user to move to an option on the display or to change characters on the display (such as numbers or writing). The selection function enables the user to move to the desired location in the menu and to confirm it by means of the selection keys. The change function scans a character string, of which the desired character is selected. The characters may act on a setting of the function (e.g. volume, piston stroke speed), or they may be confined to giving information.

FIG. 2 is a schematic view of the pipette functions. The core of the control system is a central processing unit (CPU) 10 connected with a memory 11. The CPU is used by means of the function keys, i.e. the operating switch 1 and the setting keyboard 2. The CPU is informed of the piston position by a position sensor 12. The CPU gives the commands needed for actuating the piston to a driver 13, which controls a step motor 14. The functions are indicated on the display (liquid crystal display LCD) 3. Some functions are indicated with acoustic signals by means of a buzzer 15. In addition, the CPU is connected to a serial interface 16 allowing data input into or output from the CPU. A chargeable 3.7 V Li ion battery 17 acts as the voltage source. The battery comprises a voltage control and reactivating circuit 18. The battery is charged over terminals 19 using a charger 20 in a stand 21. The charging is also controlled by the CPU.

FIG. 3 exemplifies how to change the volume of the secondary movement in direct pipetting. The PIPETTE function (direct pipetting) has been chosen from the MENU in the main menu by using selection keys 7 and 8 and scan key 9 and the volume (1000 μl) has been set. When aspirating liquid in direct pipetting, the piston is driven from the basic position to the upper position defined by the set volume and when discharging the liquid to the lower position below the basic position by a length of a so-called secondary movement. The piston stroke speed or the length of the secondary movement (phases 3 and 4) can be changed in the MENU (FIG. 3 phase 2). The display shows directly the volume (BLOWOUT VOLUME) corresponding to the secondary movement, which in phases 3 and 4 of FIG. 3 is changed from 200 μl to 300 μl.

FIG. 4 illustrates the changing of excess volume in step pipetting. In the first phase the STEPPER function (step function) has been chosen using setting keys 7 and 8 and scan key 9 and it has been set to dose 20 doses of 50 μl. When aspirating the liquid the piston is moved from the lower intake position to the basic position and further to the upper position defined by the total volume of the dosable volume. When the dosing is completed, the piston is in the basic position. The excess liquid remained in the pipette is discharged by driving the piston to the lower discharge position. The piston stroke speed, the excess volume to be aspirated (EXCESS VOLUME) or the volume corresponding to the discharge movement (BLOWOUT VOLUME) (phases 3 and 4) can be changed via MENU in the main menu. In phases 3 and 4 of FIG. 3 the excess volume is changed from 200 μl to 100 μl.

The excess volume or the discharge volume can also be changed in reverse pipetting in a similar way as in step function.

The invention claimed is:

1. A two-phase electronic pipette comprising:

a cylinder having an open end to allow a liquid to be introduced into and discharged therefrom;

a piston which is moveably positionable within the cylinder at a basic position, an upper position above the basic position, and a lower position below the basic position;

an electronic motor operably connected to the piston to cause (1) a primary movement of the piston within the cylinder from the basic position thereof away from the open end of the cylinder by a first distance to the upper position thereof so as to define a dosage volume of the liquid to be discharged from the pipette through the open end of the cylinder, and (2) a secondary movement of the piston within the cylinder from the basic position thereof towards the open end of the cylinder by a second distance to the lower position thereof; and a control system having a user interface to allow manual user inputs for setting operational adjustments of the pipette, wherein the control system issues a command to the electronic motor in response to receiving a manual user input to adjustably change the second distance of the secondary movement of the piston between the basic and lower positions thereof.

2. A pipette according to claim 1, wherein the control system is operable to drive the piston from the lower position to the upper position thereof so as to aspirate a greater than desired dosage volume of the liquid into the cylinder through the open end, and thereafter drives the piston from the upper position to the basic position to discharge the desired dosage volume of the liquid from the cylinder through the open end thereof.

3. A pipette according to claim 1, wherein the control system is operable to discharge the desired dosage volume of the liquid in a series of multiple sequential dosage volumes by step movements of the piston from the upper position to the basic position.

* * * * *